United States Patent [19]

Hill

[11] Patent Number: 4,930,534

[45] Date of Patent: Jun. 5, 1990

[54] FOLDABLE SHELTER

[76] Inventor: Peter M. Hill, 39 Carnarvon Street, East Victoria Park, Australia

[21] Appl. No.: 219,099

[22] Filed: Jul. 14, 1988

[30] Foreign Application Priority Data

Jul. 16, 1987 [AU] Australia ..... PI3176

[51] Int. Cl.[5] ..... E04H 15/00

[52] U.S. Cl. ..... 135/102; 135/109; 135/117

[58] Field of Search ..... 135/102, 104, 106, 109, 135/117, 900

[56] References Cited

U.S. PATENT DOCUMENTS

| | | | |
|---|---|---|---|
| 609,553 | 8/1898 | Lloyd | 135/102 |
| 1,819,490 | 8/1931 | Weiss | 135/102 |
| 2,142,851 | 1/1939 | Jolly | 135/102 |
| 2,266,853 | 12/1941 | Dabney | 135/104 |
| 3,190,300 | 6/1965 | Wearin | 135/104 |
| 3,540,458 | 11/1970 | Osterhoudt | 135/102 |
| 4,646,770 | 3/1987 | Lobato | 135/104 |

FOREIGN PATENT DOCUMENTS

| | | | |
|---|---|---|---|
| 144660 | 1/1952 | Australia | 135/102 |
| 1062582 | 9/1979 | Canada | 135/102 |
| 823723 | 11/1959 | United Kingdom | 135/102 |

OTHER PUBLICATIONS

Tansport 1977 Catalog.

*Primary Examiner*—David A. Scherbel
*Assistant Examiner*—Caroline D. Dennison
*Attorney, Agent, or Firm*—Harness, Dickey & Pierce

[57] ABSTRACT

A foldable shelter having a frame that is comprised solely of a foldable arch and a pair of struts that are detachably connected to the arch and receive pockets of a flexible covering that is affixed to the arch so as to provide form for the shelter when erected.

13 Claims, 4 Drawing Sheets

FOLDABLE SHELTER

This invention relates to a foldable shelter.

The invention has been devised particularly, although not solely, for use as a beach shelter.

The invention seeks to provide a foldable shelter which can be easily collapsed for transportation and storage and which can be easily erected to provide shade from the sun, shelter from oncoming winds and privacy.

In one form the invention resides in a foldable shelter comprising an arch including a bridge portion, a flexible covering attached to the arch and arranged to extend to one side of the arch, and strut means for extending between the bridge portion of the arch and the bottom edge of the covering to give form and shape to the covering thereby to provide a sheltered area.

Preferably, the arch and strut means co-operate to maintain the covering in a state of tension when the shelter is in an erected condition.

Preferably, the flexible covering includes a pair of side sections and a rear section extending between the side sections and meeting the side sections at respective junctions which extend between the arch member and the bottom edge of the covering, and wherein the strut means comprises two struts each extending from the arch member to the respective junctions between the end and side sections of the covering. The side and rear sections provide a roof and rear and side walls for the shelter.

Preferably, the arch member includes means for detachably securing the struts to the arch member. In one arrangement, said means may comprise respective recesses provided in the arch member to receive corresponding ends of the struts.

Preferably, the struts are in compression When the shelter is in the erected condition and deflect laterally to give form and shape to the covering.

Preferably, means are provided for detachably securing the struts to the flexible covering. In one arrangement, said means may comprise pockets provided on the flexible covering to receive the struts.

Preferably, a tensile member such as a rope extends between the arch and the lower end of each strut or a region of the flexible covering adjacent to the bottom end of the strut.

Preferably, the arch is foldable. In this connection, the arch may comprise an elongated member which provides said bridge portion and a pair of legs pivotally connected one to each end of said elongated member.

Preferably, the legs are provided with means for releasably engaging the ground in a positive manner. Such ground engaging means may comprise a ground engaging spike provided at the lower end of each leg.

Preferably, a skirt portion is provided at the bottom edge of the flexible covering, the skirt portion being arranged in use to lay on the ground. If desired, sand can be placed on the skirt portion to add further stability to the shelter when in an erected condition and to provide an effective weather seal between the ground and the bottom edge of the flexible covering.

The flexible covering may be perforated for ventilation purposes.

The invention will be better understood by reference to the following description of one specific embodiment thereof as shown in the accompanying drawings in which.

Figure 1:
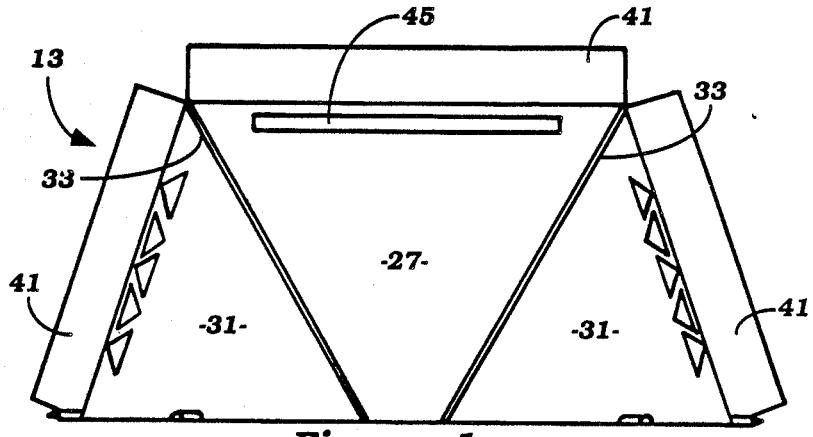
FIG. 1 is a plan view of the foldable shelter when erected.
Figure 2:
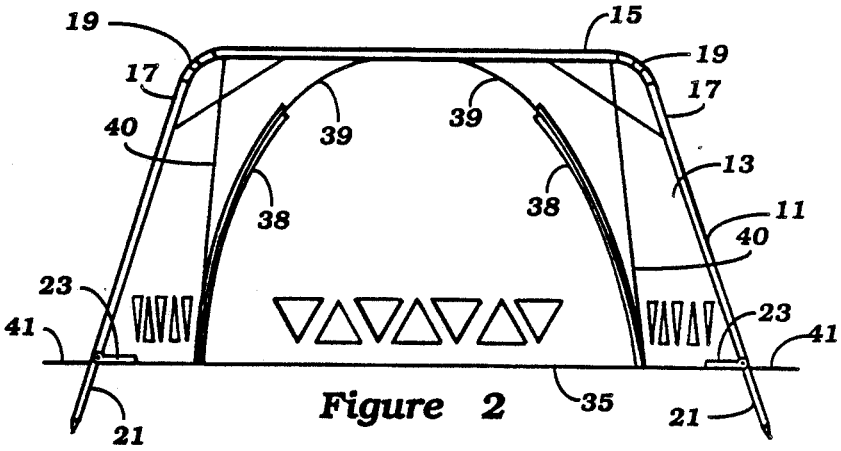
FIG. 2 is a front view of the foldable shelter.
Figure 3:
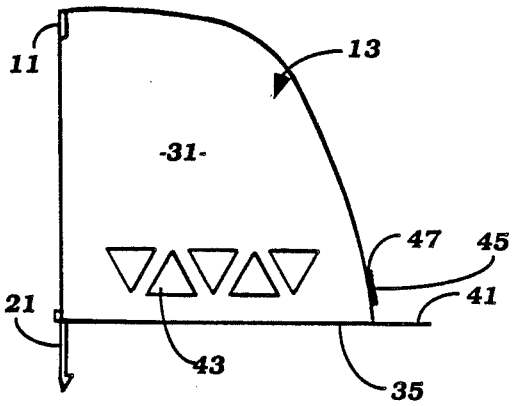
FIG. 3 is a side view of the foldable shelter.
Figure 4:
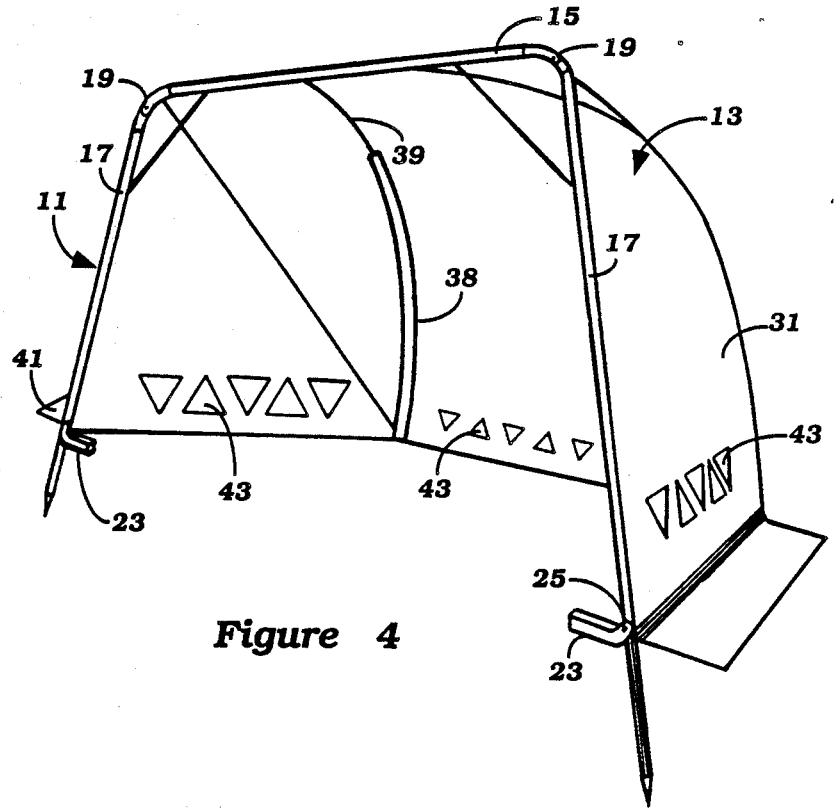
FIG. 4 is a front perspective view of the foldable shelter.
Figure 5:
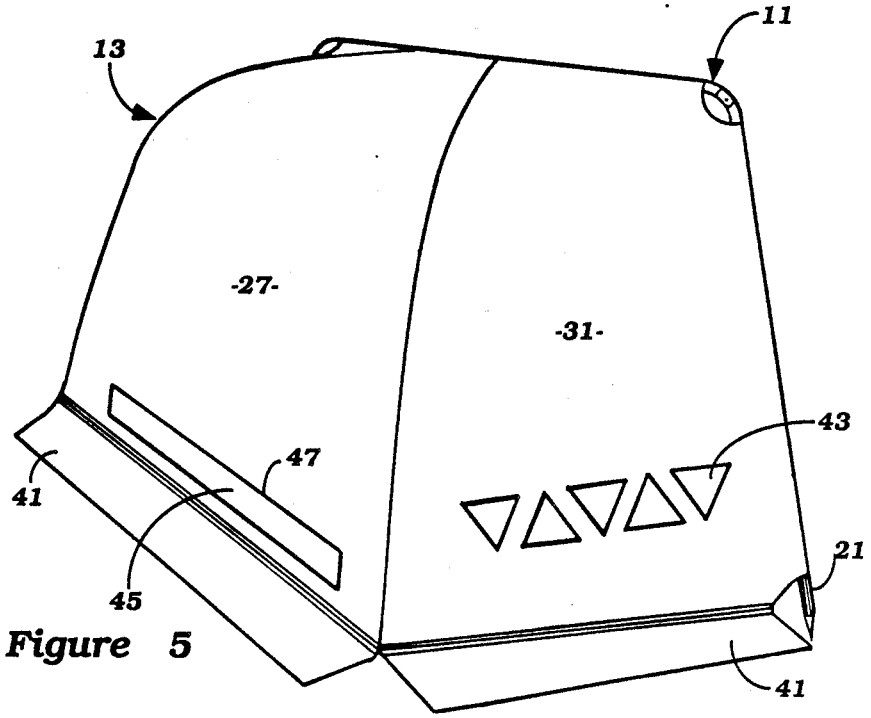
FIG. 5 is a rear perspective view of the foldable shelter.
Figure 6:
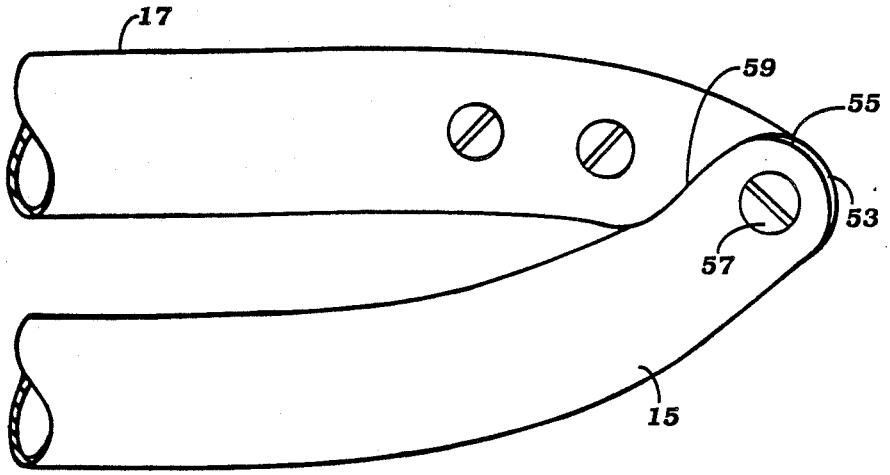
FIG. 6 is a detailed view of a pivotal joint in the foldable frame.
Figure 7:
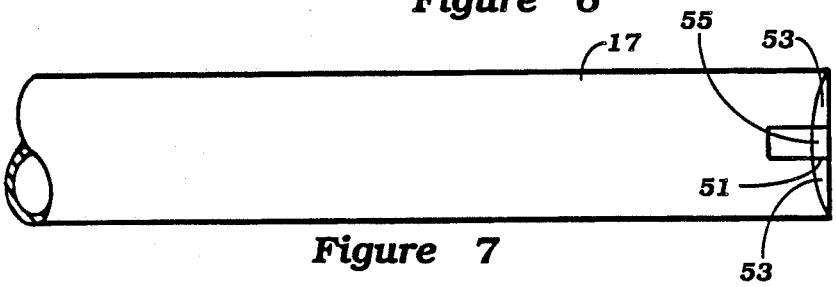
FIG. 7 is a plan view of the joint of FIG. 6.

The embodiment shown in the drawings is directed to a foldable shelter particularly intended for use on the beach to afford protection against oncoming winds and to provide shade.

The foldable shelter comprises a foldable frame 11 and a flexible covering 13. When the foldable shelter is in an erected condition, the frame 11 provides an arch and the flexible covering 13 extends to one side of the arch to provide an enclosed area in which users may seek shelter from the sun and the wind.

Figure 8:
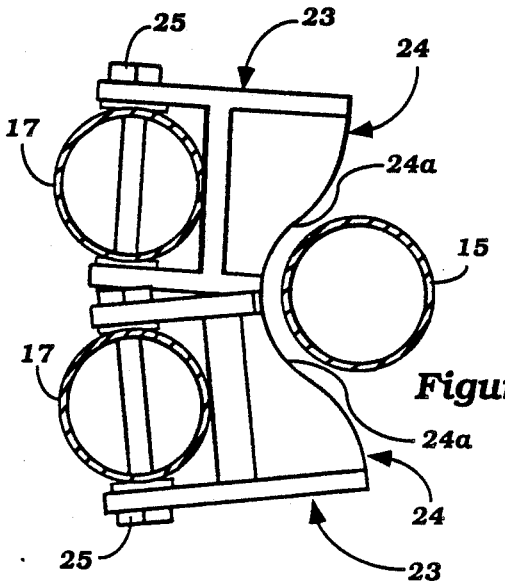
FIG. 8 is a cross-sectional view of the frame when in a folded condition.
Figure 9:
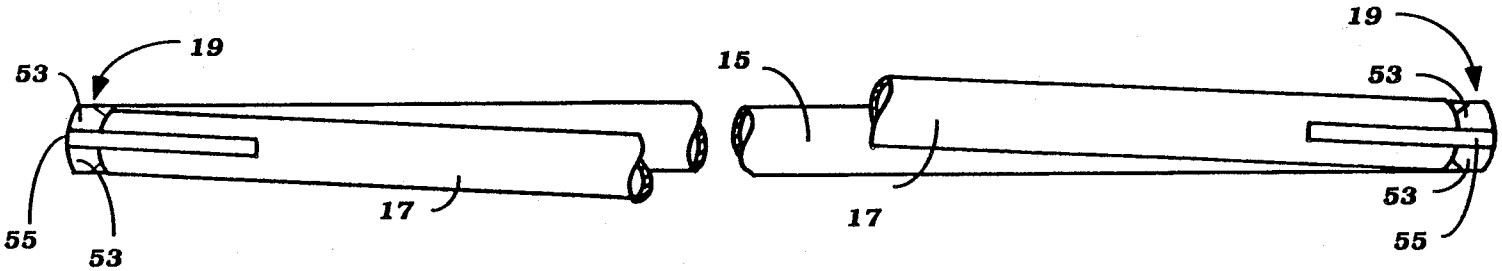
FIG. 9 is a fragmentary view of the frame in a folded condition.

The frame 11 includes an elongated bridge member 15 and a pair of legs 17 connected each to one end of the bridge member 15 by pivotal joints 19. The pivotable joints 19 permit pivotal movement of the legs 17 between erected and folded positions. The joints are so constructed that when the frame is in the folded condition the legs 17 lie one generally to each side of the bridge member 15 (as best seen in FIGS. 8 and 9) to facilitate transportation and storage of the frame. The joint 19 is so constructed as to preclude a user from pinching his or her fingers between the jointed parts when handling the frame 11. In this connection, one of the jointed parts (being the bridge member 15 in the embodiment) has an end which includes a recess 51 and a pair of curved faces 53 centered on the pivot axis and located on to each side of the recess. The other frame member (being the leg 17 in this embodiment) has an end section which includes a projecting tongue 55 adapted to be received in a recess 51 and hingedly retained therein by pivot pin 57 which provides the pivot axis. The end section of said other frame member further includes a pair of faces 59 which are disposed one to each side of the tongue 55 and which each confront one of the curved faces 53. The faces 59 have a profile which closely follows the curvature of the curved faces 53 so that no excessive gap forms between the confronting faces during relative pivotal movement between the jointed parts. The absence of such a gap ensures that there is little possibility of a user having his or her fingers pinched between the jointed parts.

The lower end of each leg 17 is provided with ground engaging means 21 in the form of a spike. Each leg 17 is further provided with a foot engaging portion 23 against which a person erecting the shelter can apply a downward force using his or her foot to assist penetration of the spike 21 into the ground. The foot engaging portion 23 is pivotally mounted at 25 to the leg 17 to permit it to be folded against the leg when the shelter is in a collapsed condition. Each foot engaging portion 23 includes a surface 24 adapted to rest against the bridge member 15 when the frame is in a folded condition. As shown in FIG. 8, the surface includes a section **24*a*** configured to the surface profile of the bridge member 15.

When the shelter is erected, the flexible covering 13 includes a rear section 27 and a pair of side sections 31. The side and rear sections provide rear and side walls and are inclined forwardly to also provide a roof, as shown in the drawings. Each side section 31 meets the rear section 27 at a junction 33 which extends from the bottom edge 35 of the flexible covering to the frame 11.

To provide the flexible covering 13 with form and shape and to maintain it in a state of tension, strut means in the form of a pair of struts 39 extends between the bottom edge of the flexible covering 13 and the bridge member 15 of the frame. The struts are under compression when in position and deflect laterally (i.e. buckle) in an outward direction to give form and shape to the covering. The struts 39 are constructed of any suitable materials such as fiberglass.

One end of each strut is releasably secured to the frame member. In this connection, the end of the strut is received in a recess formed in the frame member 15.

The other end of each strut is attached to the flexible covering 13. In this connection, the flexible covering is provided with a pocket 38 at each corner 33 for receiving the respective strut.

A tensile member 40 such as a rope extends between the bottom of each corner 33 of the flexible covering and the frame 11. The tensile members 40 serve to maintain the strut in a state of compression so as to provide structural rigidity to the shelter when erected and to maintain the flexible covering in a taut state.

A skirt portion 41 is provided along the bottom edge of the flexible covering 13. The skirt portion 41 drapes onto the ground to provide a weather seal between the ground and the flexible covering 13. To enhance the weather sealing aspect of the skirt portion, sand may be placed onto the skirt portion. Sand so placed onto the skirt portion may also serve to anchor the flexible covering 13 to the ground and thereby increase the stability of the shelter when erected.

Decorative holes 43 or other perporations are provided in the side and rear walls of the flexible covering to assist circulation of air within the shelter and to reduce wind pressure in the shelter. The holes are preferably located close to the bottom of the shelter. A flap 45 is joined at its upper edge to the outer side of the rear section 27 of the covering to cover the holes 43 in the rear walls. The junction 47 between the flap 45 and the rear section provides a hinge line about which the flap can swing. The flap co-operates with the holes 43 in the rear wall to function as a one-way valve which allows air to flow out of the area enclosed by the shelter through those holes and which inhibits flow of air into the enclosed area through those holes.

The shelter according to the embodiment can be easily erected, and easily collapsed for transportation and storage. When the frame is in the folded condition, the flexible covering can be conveniently wrapped around the folded frame for ease of handling. The struts can be placed alongside the folded frame prior to wrapping of the flexible covering thereby storing all parts in one bundle.

It should be appreciated that the scope of the invention is not limited to the scope of the embodiment described.

What is claimed is:

1. A foldable shelter consisting of a frame consisting of an arch including a bridge portion extending substantially horizontally when said shelter is erected and a pair of leg portions one at each end of said arch and forming with said bridge a generally inverted U-shaped opening when erected, a flexible covering attached to said arch and arranged to extend to one side of said arch and having a bottom edge positioned adjacent the ground when erected, and a pair of struts each extending from and affixed to said bridge portion of said arch to a respective bottom edge of said covering and being flexed by a tensile member connected between the bridge portion of the arch and the bottom edge of the covering, the struts cooperating with said flexible covering to maintain said covering in a state of tension when the shelter is in an erected condition and to give form and shape to said covering, for providing a sheltered area, said arch and said struts consisting of the sole support for said covering.

2. A foldable shelter according to claim 1 wherein said flexible covering includes a pair of side sections fixed at one end respective of said leg portions and a rear section extending between the other end of said sections and meeting said side sections at respective junctions which extend between said arch and the bottom edge of said covering and wherein the respective struts are affixed.

3. A foldable shelter according to claim 2 wherein said strut means comprises two struts each extending from said arch member to the respective junctions between said end and side sections of the covering.

4. A foldable shelter according to claim 3 wherein said struts are in comparison when the shelter is in the erected condition and deflect laterally to give form and shape to the covering.

5. A foldable shelter according to claim 3 wherein said arch member includes means for detachably securing said struts to said arch member.

6. A foldable shelter according to claim 5 wherein said securing means comprises respective recesses provided in said arch to receive corresponding ends of said struts.

7. A foldable shelter according to claim 3 wherein means are provided for detachably securing said struts to the flexible covering.

8. A foldable shelter according to claim 7 wherein said securing means comprises pockets provided on the flexible covering to receive the struts.

9. A foldable shelter according to claim 1 wherein a skirt portion is provided at the bottom edge of said flexible covering which lays on the ground in use.

10. A foldable shelter according to claim 1 wherein said flexible covering is perforated for ventilating said sheltered area.

11. A foldable shelter according to claim 1 wherein said arch is foldable.

12. A foldable shelter according to claim 11 wherein said arch comprises an elongated member which provides said bridge portion and the pair of legs are pivotally connected one to each end of said elongated member.

13. A foldable shelter according to claim 12 wherein said legs are provided with means for releasably and positively engaging the ground.

* * * * *

UNITED STATES PATENT AND TRADEMARK OFFICE

CERTIFICATE OF CORRECTION

PATENT NO. : 4,930,534

DATED : June 5, 1990

INVENTOR(S) : Peter M. Hill

It is certified that error appears in the above-identified patent and that said Letters Patent is hereby corrected as shown below:

Column 4, line 34, Claim 4, "comparison" should be --compression--.

Signed and Sealed this

Twenty-third Day of June, 1992

*Attest:*

DOUGLAS B. COMER

*Attesting Officer*

*Acting Commissioner of Patents and Trademarks*